US005385250A

United States Patent [19]

Pasquale

[11] Patent Number: 5,385,250

[45] Date of Patent: Jan. 31, 1995

[54] PLASTIC BOTTLE PARTICULARLY FOR CONTAINING BEVERAGES AND HAVING A GRIPPING RECESS

[75] Inventor: Lino Pasquale, Cittadella, Italy

[73] Assignee: SocietáGestione Acque Minerali, San Giorgo in Bosco, Italy

[21] Appl. No.: 984,664

[22] Filed: Dec. 2, 1992

Related U.S. Application Data

[63] Continuation of Ser. No. 669,551, Mar. 14, 1991, abandoned.

[30] Foreign Application Priority Data

Mar. 22, 1990 [IT] Italy ..... 41566 A/90

[51] Int. Cl.[6] ..... B65D 1/02; B65D 23/10

[52] U.S. Cl. ..... 215/1 C; 215/100 A; 220/669; 220/675; 220/771

[58] Field of Search ..... 215/1 C, 100 A; 220/771, 758, 669, 675

[56] References Cited

U.S. PATENT DOCUMENTS

| | | | |
|---|---|---|---|
| 3,185,353 | 5/1965 | Mercier | 215/1 C X |
| 3,403,804 | 10/1968 | Colombo | 215/1 C X |
| 3,537,498 | 11/1970 | St Amand | 215/100 A |
| 3,934,743 | 1/1976 | McChesney et al. | 215/1 C |
| 4,046,275 | 9/1977 | Virog, Jr. et al | 215/1 C |
| 4,082,200 | 4/1978 | Guest et al. | 215/1 C |
| 4,274,548 | 6/1981 | Schneider | 220/675 |
| 4,406,854 | 9/1983 | Yoshino | 215/1 C X |
| 4,497,855 | 2/1985 | Agrawal et al. | 215/1 C X |
| 4,579,260 | 4/1986 | Young et al. | 215/1 C X |
| 4,733,804 | 3/1988 | Slat et al. | 220/675 X |
| 4,805,808 | 2/1989 | Larson | 215/1 C X |
| 4,877,141 | 10/1989 | Hayashi et al. | 215/1 C |
| 4,993,565 | 2/1991 | Ota et al. | 215/1 C |

FOREIGN PATENT DOCUMENTS

| | | | |
|---|---|---|---|
| 55595 | 7/1982 | European Pat. Off. | 215/1 C |
| 1333343 | 6/1963 | France | 215/1 C |
| 1353643 | 1/1964 | France | 215/1 C |
| 1383069 | 12/1964 | France . | |
| 2025889 | 1/1980 | United Kingdom . | |

*Primary Examiner*—Sue A. Weaver
*Attorney, Agent, or Firm*—Guido Modiano; Albert Josif; Daniel O'Byrne

[57] ABSTRACT

The bottle, particularly suitable for carbonated beverages, is of the type with a substantially cylindrical shape and is provided circumferentially with at least one deep annular groove with a quadrangular cross section.

11 Claims, 1 Drawing Sheet

PLASTIC BOTTLE PARTICULARLY FOR CONTAINING BEVERAGES AND HAVING A GRIPPING RECESS

This is a continuation application of application Ser. No. 07/669,551 filed on Mar. 14, 1991, now abandoned.

BACKGROUND OF THE INVENTION

The present invention relates to a plastic bottle particularly for containing beverages.

The bottle is particularly suitable for the containment of carbonated beverages such as mineral waters, orangeades or other beverages to which carbon dioxide is added.

It is known that plastic bottles suitable for the containment of carbonated beverages, of the kind currently used in the 1.5- or 2-liter size, must have a body which is more resistant than the others.

The greater resistance of these bottles, which are manufactured with the method of blow molding, is usually obtained by increasing the thickness of their body.

This naturally increases the amount of raw material used and consequently the cost of the bottles.

In order to solve this disadvantage, bottles which are circumferentially provided with slight annular reinforcement grooves with a triangular cross section have been made commercially available, but the practical results have not been up to the expectations, since due to the filling and to the consequent tensions to which the bottle is subjected its outer surface tends to stretch longitudinally, consequently stretching the annular grooves, which achieve no effect.

The surface of bottles for beverages is furthermore generally completely smooth and also has a considerable diameter (approximately 85 mm), so that gripping with a user's hands is often troublesome.

SUMMARY OF THE INVENTION

The aim of the present invention is to provide a plastic bottle of the type commonly used for the containment of carbonated beverages in the 1.5- or 2-liter size which solves the disadvantages described above in the known art.

A consequent primary object is to provide a bottle which, despite being suitable for the containment of carbonated beverages, is equal in cost to those suitable for non-carbonated beverages.

Not least, the object is to provide a bottle which is not more difficult to manufacture than currently commercially available bottles.

This aim, these objects and others which will become apparent hereinafter are achieved by a plastic bottle of the type with a substantially cylindrical shape, characterized in that it circumferentially comprises at least one deep annular groove with a quadrangular cross section.

BRIEF DESCRIPTION OF THE DRAWINGS

Further characteristics and advantages of the invention will become apparent from the detailed description of an embodiment thereof, illustrated only by way of nonlimitative example in the accompanying drawings, wherein.

DESCRIPTION OF THE PREFERRED EMBODIMENTS

Figure 1:
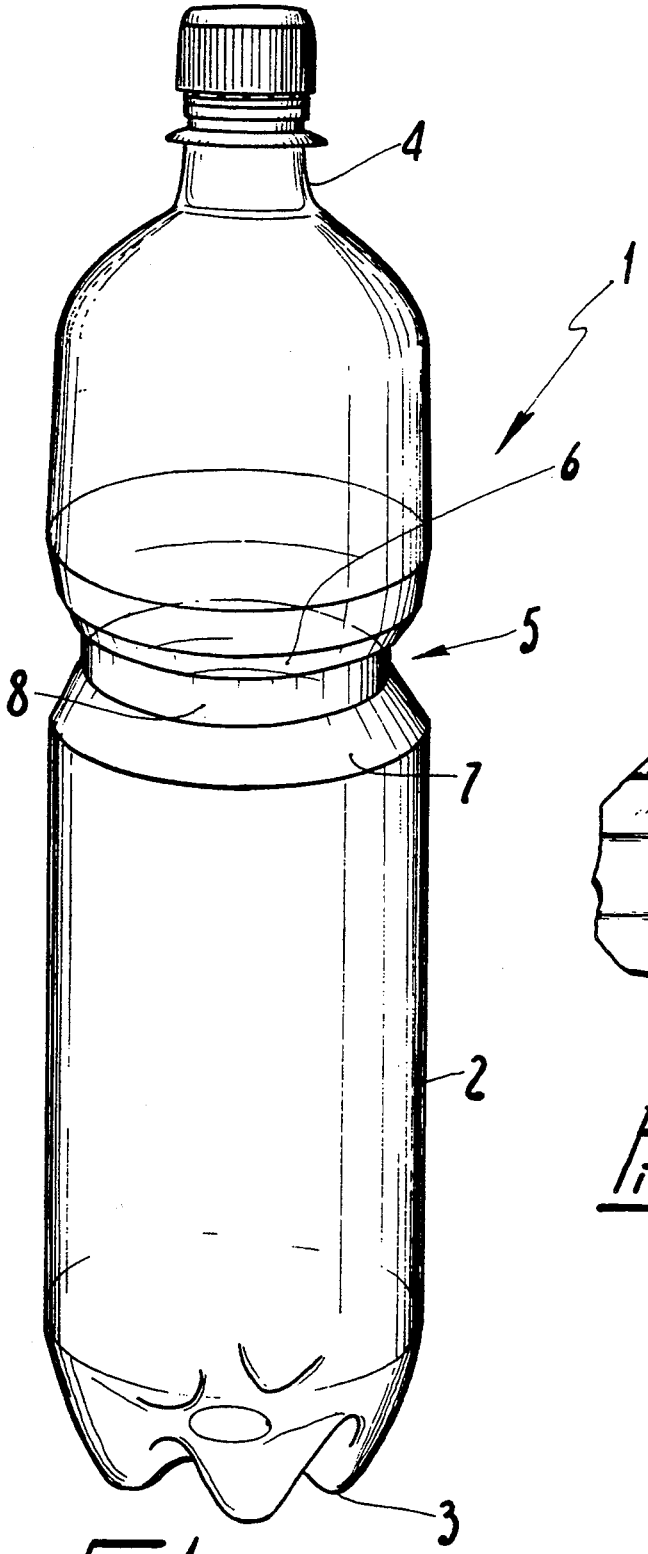
FIG. 1 is a perspective view of the bottle according to the invention.
Figure 2:
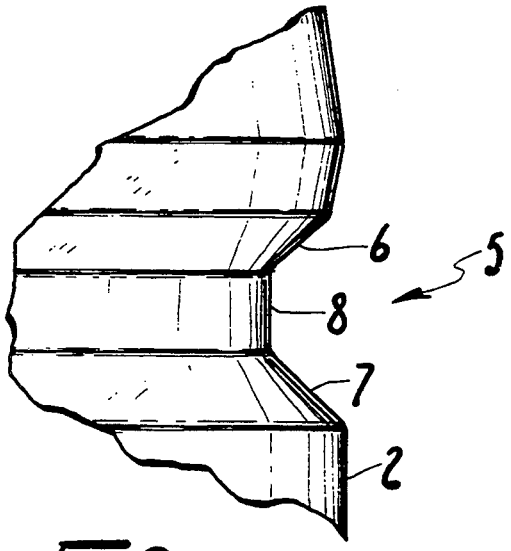
FIG. 2 is an enlarged perspective view of a detail of the bottle of FIG. 1.

With reference to the above figures, the bottle is indicated by the reference numeral 1 and comprises a cylindrical body 2, a shaped bottom 3 at a first end of the body 2, and, at a second end of the body 2, a neck 4 with a thread for a closure.

The bottle 1 is made of plastic material with conventional methods of blow molding, in particular with the material commonly indicated by the acronym PET.

According to the invention, the bottle 1 is circumferentially provided, in an upper region of the body 2 (i.e. in the upper half of the body 2 closest to the neck 4), with a deep annular groove 5 having a quadrangular cross section which is in particular a cross section in the shade of an equilateral trapezoid.

The groove 5 therefore comprises two annular bands 6 and 7 with a conical shape which are connected by an inner cylindrical band 8.

Since the bottle 1 is manufactured by blow molding, as mentioned previously, the amount of material which deposits on every part of the parison in its initial shape is the same, and since the band 8 of the finished bottle has a considerably smaller diameter than the body 2, after blowing the thickness at the band 8 is greater than that of the other parts of the body, so that it is considerably resistant and the groove 5 is not subjected to stretchings.

The inner band 8 in practice has a function which is comparable to that of the reinforcement hoops of barrels.

It should also be pointed out, considering the fact that the bottle will be preferably manufactured in the currently commercially used 1.5- and 2-liter sizes, that the local diameter reduction caused by the presence of the groove 5, provided at a grip area of the upper region of the body 2, allows a better grip with a user's hands with respect to current bottles.

Finally, the fact that in practice the amount of material used is equal or slightly greater than that used for bottles for non-carbonated beverages provides a further advantage of the present invention.

It has thus been observed in practice that the bottle according to the invention has achieved the intended aim and objects.

The invention thus conceived is susceptible to numerous modifications and variations, all of which are within the scope of the inventive concept.

All the details may furthermore be replaced with other technically equivalent elements.

In practice, the materials employed, so long as compatible with the contingent use, may be any according to the requirements.

I claim:

1. A blow-molded plastic bottle comprising:

a cylindrical body (2); and means for gripping said cylindrical body by a user's hands;

said means for gripping said cylindrical body by a user's hands comprising a deep annular groove (5) provided circumferentially in said cylindrical body, said groove having a quadrangular cross section comprising two conically shaped annular bands (6,7) and an inner cylindrical band which is mutually interconnected between said annular bands, said inner cylindrical band having a diameter which is smaller than the diameter of said cylindrical body at its other parts which do not include said annular groove, said cylindrical band having a thickness which is greater than the thickness of said cylindrical body at its said other parts which do not include said annular groove.

2. The bottle of claim 1, wherein said annular groove is provided at an upper region of said cylindrical body.

3. The bottle of claim 1, wherein said groove has a cross section in the shape of an equilateral trapezoid.

4. The bottle of claim 1, wherein said bottle is substantially of the 1.5 liter size.

5. The bottle of claim 1, wherein said bottle is substantially of the 2.0 liter size.

6. The bottle of claim 1, wherein said cylindrical body has a first end at which is provided a shaped bottom (3) and a second end at which is provided a neck (4) provided with a thread for a closure element.

7. A method of holding a plastic bottle of the type comprising a cylindrical body, the method comprising the steps of:

providing a deep annular groove circumferentially in said cylindrical body, wherein said groove has a quadrangular cross section comprising two conically shaped annular bands and an inner cylindrical band which is mutually interconnected between said annular bands, wherein said inner cylindrical band has a diameter which is smaller than the diameter of said cylindrical body at its other parts which do not include said annular groove, and wherein said cylindrical band has a thickness which is greater than the thickness of said cylindrical body at its said other parts which do not include said annular groove; and gripping said deep annular groove with a user's hands.

8. The method of claim 7, wherein said annular groove is provided at an upper region of said cylindrical body.

9. The method of claim 7, wherein said groove has a cross section in the shape of an equilateral trapezoid.

10. The method of claim 7, wherein said bottle is substantially of the 1.5 liter size.

11. The method of claim 7, wherein said bottle is substantially of the 2.0 liter size.

* * * * *